United States Patent [19]

Waszkelewicz

[11] Patent Number: 4,722,524

[45] Date of Patent: Feb. 2, 1988

[54] WEIGHT LIFTING AID

[76] Inventor: Paul Waszkelewicz, 159 Standish St., Hartford, Conn. 06114

[21] Appl. No.: 897,071

[22] Filed: Aug. 18, 1986

[51] Int. Cl.[4] ..... A63B 13/00

[52] U.S. Cl. ..... 272/123; 224/265

[58] Field of Search ..... 272/93, 119, 123; 128/78, 87 B; 224/265, 266, 270

[56] References Cited

U.S. PATENT DOCUMENTS

| | | | |
|---|---|---|---|
| 796,589 | 8/1905 | Maloney | 224/256 |
| 3,679,107 | 7/1972 | Perrine | 272/123 X |
| 3,724,846 | 4/1973 | Perrine | 272/123 X |
| 4,213,605 | 7/1980 | McPeak | 272/119 |
| 4,629,183 | 12/1986 | Perrine | 272/123 |
| 4,676,502 | 6/1987 | Mahr | 272/119 |

FOREIGN PATENT DOCUMENTS

| | | | |
|---|---|---|---|
| 779572 | 4/1935 | France | 272/119 |

OTHER PUBLICATIONS

Advertisement for "Super Squat" In Strength and Health, p. 9, Dec. 1971.

Advertisement for "Super Shoulder Pads" in The Sporting Goods Dealer, p. 128, Aug. 1983.

*Primary Examiner*—Richard J. Apley

*Assistant Examiner*—Robert W. Bahr

*Attorney, Agent, or Firm*—CTC & Associates

[57] ABSTRACT

A weight lifting aid comprises an elongated member that can be worn by a lifter either (a) across the shoulders for use in lifting a barbell on the shoulders, in which case the aid redistributes the weight laterally away from the nape of the neck or (b) across the abdomen for use doing arm curls.

4 Claims, 4 Drawing Figures

WEIGHT LIFTING AID

BACKGROUND OF THE INVENTION

This invention relates to a weight lifting aid and more particularly to a multi-purpose weight lifting aid which is useful as an aid for barbell lifting on the shoulders as its primary function and as an aid for doing arm curls as its secondary function.

An important object of the invention is to provide an improved weight lifting aid which can be used either for lifting a barbell on the shoulders or for doing arm curls.

Another object is to provide such an aid which, when used for lifting a barbell on the shoulders will disperse the weight of the barbell laterally across the entire upper back muscles, i.e., the deltoid, the trapezius, the infra-spinatus, the rhomboideus and the teres major.

Normally, the barbell shaft rests, and the weight is concentrated, on the upper central portion of the trapezius (the nape of the neck). When a lifter starts working out with greater weights, this weight concentration can cause great pain and can bruise the nape area. The pain can divert the lifter's attention from the lift, the form and the technique.

By dispersing the weight across the upper back and shoulders, an aid embodying the invention alleviates the pain and pressure, thus allowing the lifter to concentrate totally on the sets, in turn enabling the lifter to do more sets and eventually add more weight, increasing ability and strength.

It is a further object to provide a weight lifting aid which can be used for shoulder lifts without requiring that the aid be strapped in place, in such manner that the lifter need not be concerned with balancing the aid.

It is an additional object to provide a weight lifting aid which can be used either for shoulder lifting as mentioned above or for arm curls to build chest and arm muscles, in which case attachable straps are added for attaching the aid on the front of the lifter's abdomen.

It is a still further object to provide a weight lifting aid which is light in weight and inexpensive and which can be used by lifters of various sizes, thereby minimizing the number of sizes in which the aid must be provided.

Other objects and advantages will appear hereinafter.

A patentability search hereon has revealed the following U.S. Pat. Nos: 3,679,107 on July 25, 1972 to Perrine, 3,724,846 on Apr. 3, 1973 to Perrine.

The '107 patent discloses a lifting yoke for shoulder use only. The yoke distributes the weight off the end of the spinal column and along the back of the user.

The '846 patent discloses a yoke which can be used in doing arm curls only. The yoke is supported by straps from the shoulders and fits across the lifter's chest. The ends of the yoke fit back of the triceps muscles to restrain the forearm from moving the biceps and triceps muscles from a vertical position during a weight lifting operation.

It is believed that the '107 patent and the '846 patent are irrelevant to the present invention.

The foregoing and other objects and advantages will appear more clearly hereinafter.

SUMMARY OF THE INVENTION

A weight lifting aid embodying the invention comprises an elongated member symmetrical with respect to a central plane and having a generally concave under surface conforming generally to a lifter's anatomy across the shoulders, a central portion conforming generally to the nape of the lifter's neck, an upper surface including a pair of upwardly projecting bosses provided with coaxial semi-cylindrical grooves equidistant from the central plane.

The ends of the member remote from the central plane have integral generally aligened tabs having surfaces facing generally in the same direction as the grooves.

The aid may be worn either across the shoulders, in which case no straps are needed, or it may be worn across the abdomen with the tabs back of the lifter's elbows with the tab surfaces confronting and engaging and restraining the elbows, in which case the aid may be held in place by straps.

DESCRIPTION OF THE INVENTION

Figure 1:
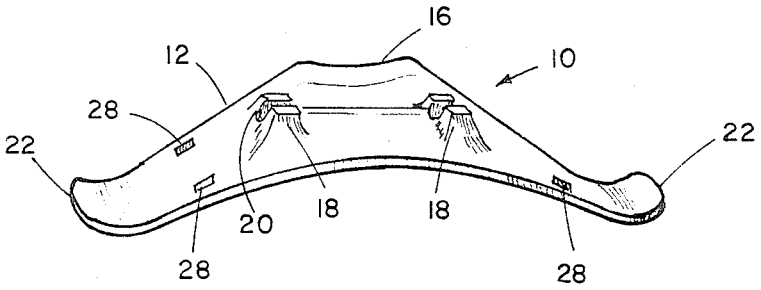
FIG. 1 is a perspective view of a preferred weight lifting aid embodying the invention.

The drawing shows a weight lifting aid, indicated generally at 10, which is a preferred embodiment of the invention. Aid 10 which can be of any suitable material, such, for example, as polyethylene or fiberglass, comprises a one-piece member 12 that is rather elongated and symmetrical with respect to a central plane that bisects member 12.

Member 12 has a generally concave under surface (not shown) that may be provided with padding such as foam rubber and conforms generally to the anatomy of a lifter 14 or a dummy 15 across the shoulders from one shoulder to the other.

Member 12 further has a central portion 16 (best seen in FIG. 3) conforming generally to the nape of the neck of lifter 14.

Member 16 further has an upper surface having a pair of upwardly projecting bosses 18 and provided with coaxial semicylindrical grooves 20 (best seen in FIG. 1). Bosses 18 and grooves 20 are equidistant from the central plane, and the axis of grooves 20 is located to be substantially directly above the shoulders of lifter 14.

The ends of member 12 remote from the central plane are provided with integral generally aligned tabs 22 having upper surfaces 24 (best seen in FIG. 2) that are either aligned with each other or make a slight dihedral angle with each other.

Figure 2:
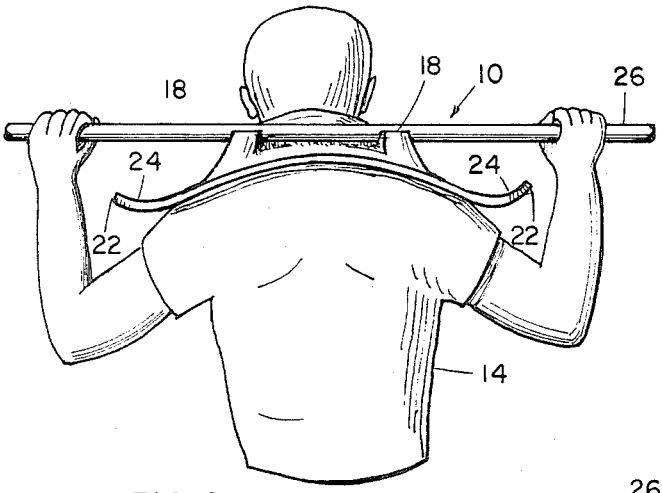
FIG. 2 is a rear view of the upper portion of a lifter showing the weight lifting aid of FIG. 1 worn across the shoulders of the lifter and also showing fragmentarily a barbell shaft held by the lifter's hands.
Figure 3:
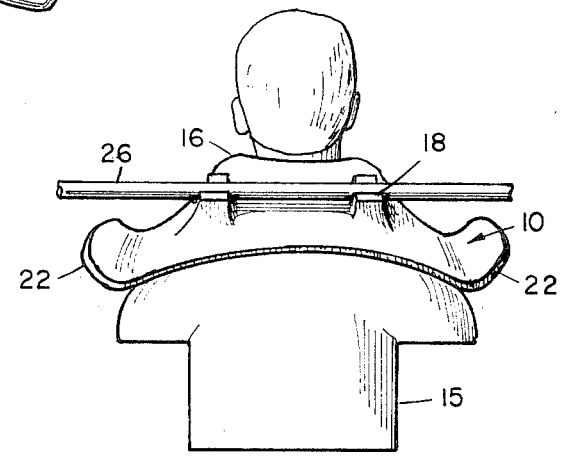
FIG. 3 is a view similar to FIG. 2, but showing the weight lifting aid of FIG. 1 worn by a dummy, the aid being shown from a slightly different angle from FIG. 2.

Aid 10 is seen in FIG. 2 worn by a lifter 14 and in FIG. 3 worn by a dummy 15, in both cases worn across the shoulders. Also seen in FIGS. 2 and 3 is a shaft 26 of a barbell, the weights at the ends thereof not being shown. Shaft 26 is shown in FIG. 2 being held by the lifter's hands, ready for shoulder lifts in the primary function of aid 10.

To revert to grooves 20, the diameter thereof is slightly greater than the diameter of shaft 26 and grooves 20 are slightly less than 180° in circumferential extent, so that shaft 26 is not tightly held by grooves 20.

Aid 10 redistributes the weight of the barbell laterally across the shoulders of lifter as aforesaid when aid 10 is used in its primary function.

No straps are needed for using aid 10 in its primary function as shown in FIGS. 2 and 3, but the upper surface of member 12 is provided with four integral apertures 28 (FIG. 1) which may be used to accommodate straps (not shown) to hold aid 10 on lifter 14 when aid 10 is used in its secondary function, i.e., for arm curls.

Figure 4:
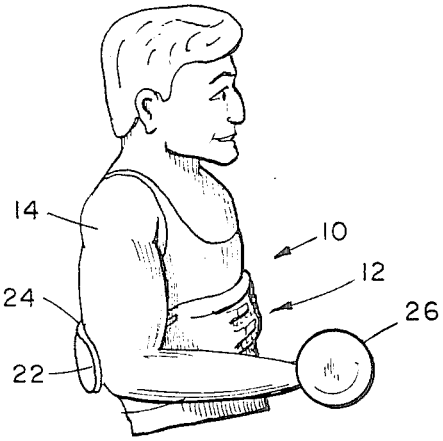
FIG. 4 is a side view of a person using the weight lifting aid of FIG. 1 as an elbow restraint for doing arm curls.

The secondary function use is shown in FIG. 4. More particularly, for such use, aid 10 is placed with its concave undersurface spanning the abdomen of lifter 14 with tabs 22 back of the elbows of lifter 14, with surfaces 24 providing elbow restraint as lifter 14 lifts barbell shaft 26. Possibly in this mode, aid 10 will be strapped to lifter 14, making use of apertures 28.

It is apparent that the invention attains the stated objects and advantages and others.

The disclosed details are exemplary only and are not to be taken as limitations on the invention except as those details may be included in the appended claims.

What is claimed is:

1. A weight lifting aid comprising an elongated member symmetrical with respect to a central plane bisecting said member, said member having a generally concave under surface conforming generally to a lifter's anatomy across the shoulders, a central portion having means for conforming said member generally to the nape of the lifter's neck, an upper surface including a pair of upwardly projecting bosses provided with coaxial semi-cylindrical grooves equidistant from the central plane, the curvature of said generally concave under surface being about an axis perpendicular to the axis of said semi-cylindrical grooves, and the ends of said member remote from the central plane having integral generally aligned tabs having surfaces facing in generally the same direction as said grooves, whereby said aid is wearable by the lifter with said generally concave under surface conforming to the lifter either across the shoulders for lifting a barbell on the shoulders or across the front of the abdomen with said tab surfaces behind and engaging and restraining the lifter's elbows for doing arm curls.

2. An aid according to claim 1 wherein said under surface of said member has padding affixed thereto.

3. An aid according to claim 1 wherein said member further comprises apertures for accommodating straps.

4. An aid according to claim 1 wherein said tab surfaces make a slight dihedral angle with each other to facilitate the restraining action of said tab surfaces on the lifter's elbows when said aid is worn for doing arm curls.

* * * * *